US008118600B2

(12) United States Patent
Miki et al.

(10) Patent No.: US 8,118,600 B2
(45) Date of Patent: Feb. 21, 2012

(54) INSERTING CONNECTOR, CONNECTOR UNIT, AND BACKPLANE

(75) Inventors: Yasuyuki Miki, Tokyo (JP); Mitsuru Kobayashi, Tokyo (JP); Hiroshi Tajiri, Tokyo (JP); Takahiro Kondou, Kawasaki (JP); Koji Ishikawa, Kawasaki (JP); Akira Tamura, Kawasaki (JP)

(73) Assignees: Fujitsu Component Limited, Toyko (JP); Fujitsu Limited, Kawasaki (JP)

( * ) Notice: Subject to any disclaimer, the term of this patent is extended or adjusted under 35 U.S.C. 154(b) by 26 days.

(21) Appl. No.: 12/884,637

(22) Filed: Sep. 17, 2010

(65) Prior Publication Data

US 2011/0086521 A1 Apr. 14, 2011

(30) Foreign Application Priority Data

Oct. 8, 2009 (JP) ..... 2009-234156

(51) Int. Cl.
*H01R 12/00* (2006.01)

(52) U.S. Cl. ..... 439/65; 439/79

(58) Field of Classification Search ..... 439/65, 439/79, 527, 529, 540.1, 544
See application file for complete search history.

(56) References Cited

U.S. PATENT DOCUMENTS

| | | | | |
|---|---|---|---|---|
| 4,932,888 | A * | 6/1990 | Senor | 439/108 |
| 5,743,751 | A * | 4/1998 | Davis et al. | 439/79 |
| 5,947,753 | A * | 9/1999 | Chapman et al. | 439/79 |
| 6,077,093 | A * | 6/2000 | Seong et al. | 439/79 |
| 6,554,651 | B2 * | 4/2003 | Crane, Jr. | 439/660 |

FOREIGN PATENT DOCUMENTS

JP 2001-319753 11/2001

* cited by examiner

*Primary Examiner* — Khiem Nguyen
(74) *Attorney, Agent, or Firm* — IPUSA, PLLC

(57) ABSTRACT

An inserting connector includes a plurality of plug electrodes where plug connecting terminals are provided at first ends of the plug electrodes and plug terminals are provided at second ends of the plug electrodes, the plug connecting terminals being configured to be connected to a board, the plug terminals being configured to be connected to jack terminals; wherein the plug connecting terminals extend in a direction perpendicular to a surface of the board; the plug terminals extend in a movable direction where the plug terminals are attached to or detached from the jack terminals; the plug electrodes are bent at an angle α in longitudinal directions of the plug electrodes, the angle α being greater than 0 degrees and less than 90 degrees.

16 Claims, 15 Drawing Sheets

INSERTING CONNECTOR, CONNECTOR UNIT, AND BACKPLANE

CROSS-REFERENCE TO RELATED APPLICATIONS

This patent application is based upon and claims the benefit of priority of Japanese Patent Application No. 2009-234156 filed on Oct. 8, 2009, the entire contents of which are incorporated herein by reference.

BACKGROUND OF THE INVENTION

1. Field of the Invention

The present invention generally relates to inserting connectors, connector units, and backplanes.

2. Description of the Related Art

A communication device or the like may have a structure where a backplane and plural boards vertically connected to the backplane are provided inside the communication device or the like. Plug connectors are provided at the back plane. Jack connectors are provided at end parts of the boards to be connected. By connecting the jack connectors and the plug connectors, the backplane and each of the boards are electrically connected to each other.

In recent years, transmission rates of signals have become high. Therefore, a structure where signal transmission contacts are arranged two-dimensionally is applied to the above-mentioned jack connector. In other words, members where there are contact modules having signal transmission contacts and shield members mutually arranged in close proximity are provided in a multi-step manner. See, for example, Japanese Laid-Open Patent Application Publication No. 2001-319753.

However, there is a limitation of the number of the connectors which can be connected to the backplane. Because of this, there is limitation of making the transmission rate high.

SUMMARY OF THE INVENTION

Accordingly, embodiments of the present invention may provide a novel and useful inserting connector, connector unit, and backplane solving one or more of the problems discussed above.

More specifically, the embodiments of the present invention may provide a structure whereby a large number of connectors can be connected between a board and a backplane so that a transmission rate between the board and the backplane can be improved.

Another aspect of the embodiments of the present invention may be to provide an inserting connector, including a plurality of plug electrodes where plug connecting terminals are provided at first ends of the plug electrodes and plug terminals are provided at second ends of the plug electrodes, the plug connecting terminals being configured to be connected to a board, the plug terminals being configured to be connected to jack terminals;

wherein the plug connecting terminals extend in a direction perpendicular to a surface of the board;

the plug terminals extend in a movable direction where the plug terminals are attached to or detached from the jack terminals;

the plug electrodes are bent at an angle $\alpha$ in longitudinal directions of the plug electrodes, the angle $\alpha$ being greater than 0 degrees and less than 90 degrees.

Another aspect of the embodiments of the present invention may be to provide a connector unit, including the above-mentioned inserting connector; and a receiving connector provided at another board to be connected to the board, the receiving connector including the jack terminals where the plug terminals are inserted in the movable direction where the plug terminals are attached to or detached from the jack terminals.

Another aspect of the embodiments of the present invention may be to provide a backplane provided as the above-mentioned board, the backplane being where the inserting connector as claimed in claim 1 is attached.

According to the embodiments of the present invention, it is possible to provide a large number of connectors between the board and the backplane. Therefore, it is possible to provide an inserting connector whereby the transmission rate is improved, a connector unit, and a backplane.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 15 of embodiments of the present invention.

(Backplane)

First, a backplane of the embodiment of the present invention and a board to be connected to the backplane are discussed.

Figure 1:
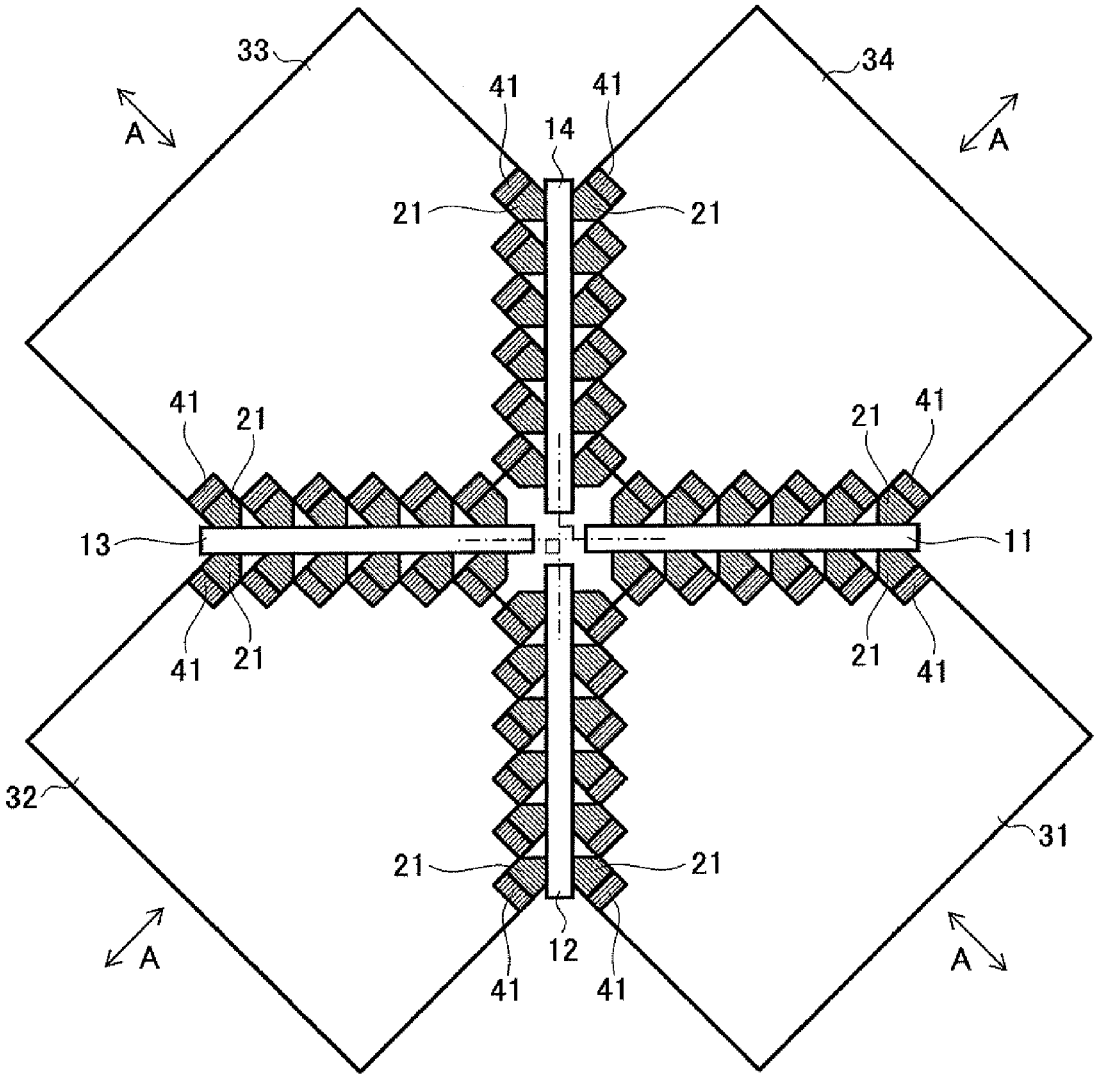
FIG. 1 is a schematic view of plural boards configured to be connected to a backplane of an embodiment of the present invention.

As illustrated in FIG. 1, in the embodiment of the present invention, four backplanes 11, 12, 13, and 14 which are kinds of boards, are provided at right angles (90 degrees) to each other. Plural inserting connectors 21 are provided at both surfaces of each of the backplanes 11, 12, 13, and 14. The backplane of the embodiment of the present invention includes not only a backplane where the connectors are provided at one of surfaces of the backplane but also a midplane where the connectors are provided at both surfaces of the backplane. Plural receiving connectors 41 corresponding to the inserting connectors 21 are provided at boards 21, 32, 33, and 34 which are connected to the backplanes 11, 12, 13, and 14.

Electrical connection between the boards 31, 32, 33, and 34 and the backplanes 11, 12, 13, and 14 is made by connecting plural receiving connectors 41 provided at the boards 31, 32, 33, and 34 and corresponding plural inserting connectors 21 provided at the backplanes 11, 12, 13, and 14.

More specifically, in this embodiment, plural inserting connectors 21 are provided, in a single-line manner, at both sides of the backplanes 11, 12, 13, and 14. On the other hand, each of the boards 31, 32, 33, and 34 has a substantially pentagonal shaped configuration having three right angle corners. The receiving connectors 41 are provided, in a single-line manner, along two sides forming one of the right angle corners.

The receiving connectors 41 of the board 31 and the inserting connectors 21 provided at the backplanes 11 and 12 are connected to each other so that the board 31 and the backplanes 11 and 12 are connected to each other. In addition, the receiving connectors 41 of the board 32 and the inserting connectors 21 provided at the backplanes 12 and 13 are connected to each other so that the board 32 and the backplanes 12 and 13 are connected to each other. In addition, the receiving connectors 41 of the board 33 and the inserting connectors 21 provided at the backplanes 13 and 14 are connected to each other so that the board 33 and the backplanes 13 and 14 are connected to each other. In addition, the receiving connectors 41 of the board 34 and the inserting connectors 21 provided at the backplanes 11 and 14 are connected to each other so that the board 34 and the backplanes 11 and 14 are connected to each other. In other words, the board 31 and two backplanes 11 and 12 are connected to each other; the board 32 and two backplanes 12 and 13 are connected to each other; the board 33 and two backplanes 13 and 14 are connected to each other; and the board 34 and two backplanes 11 and 14 are connected to each other. The boards 31, 32, 33, and 34 can be taken out from the backplanes 11, 12, 13, and 14 by pulling out the boards 31, 32, 33, and 34 in directions indicated by corresponding arrows A so that the inserting connectors 21 and the receiving connectors 41 are separated from each other. In addition, the boards 31, 32, 33, and 34 and the backplanes 11, 12, 13, and 14 can be connected to each other by pushing in the boards 31, 32, 33, and 34 to the backplanes 11, 12, 13, and 14 in the directions indicated by the arrows A so that the inserting connectors 21 and the receiving connectors 41 are connected to each other. The directions indicated by the arrows A are called, hereinafter removable directions.

Figure 2:
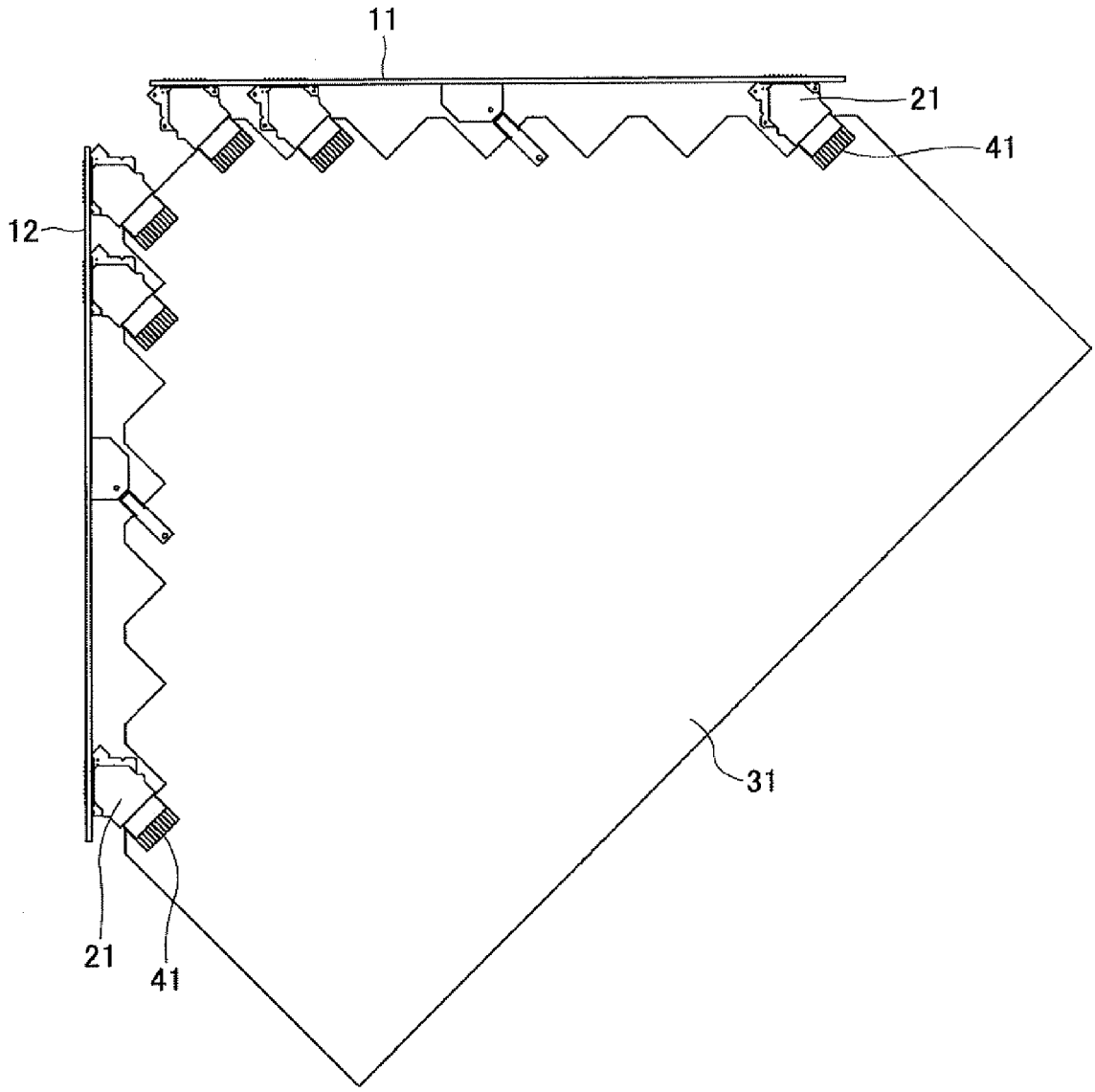
FIG. 2 is a top view of the board configured to be connected to the backplane of the embodiment of the present invention.
Figure 3:
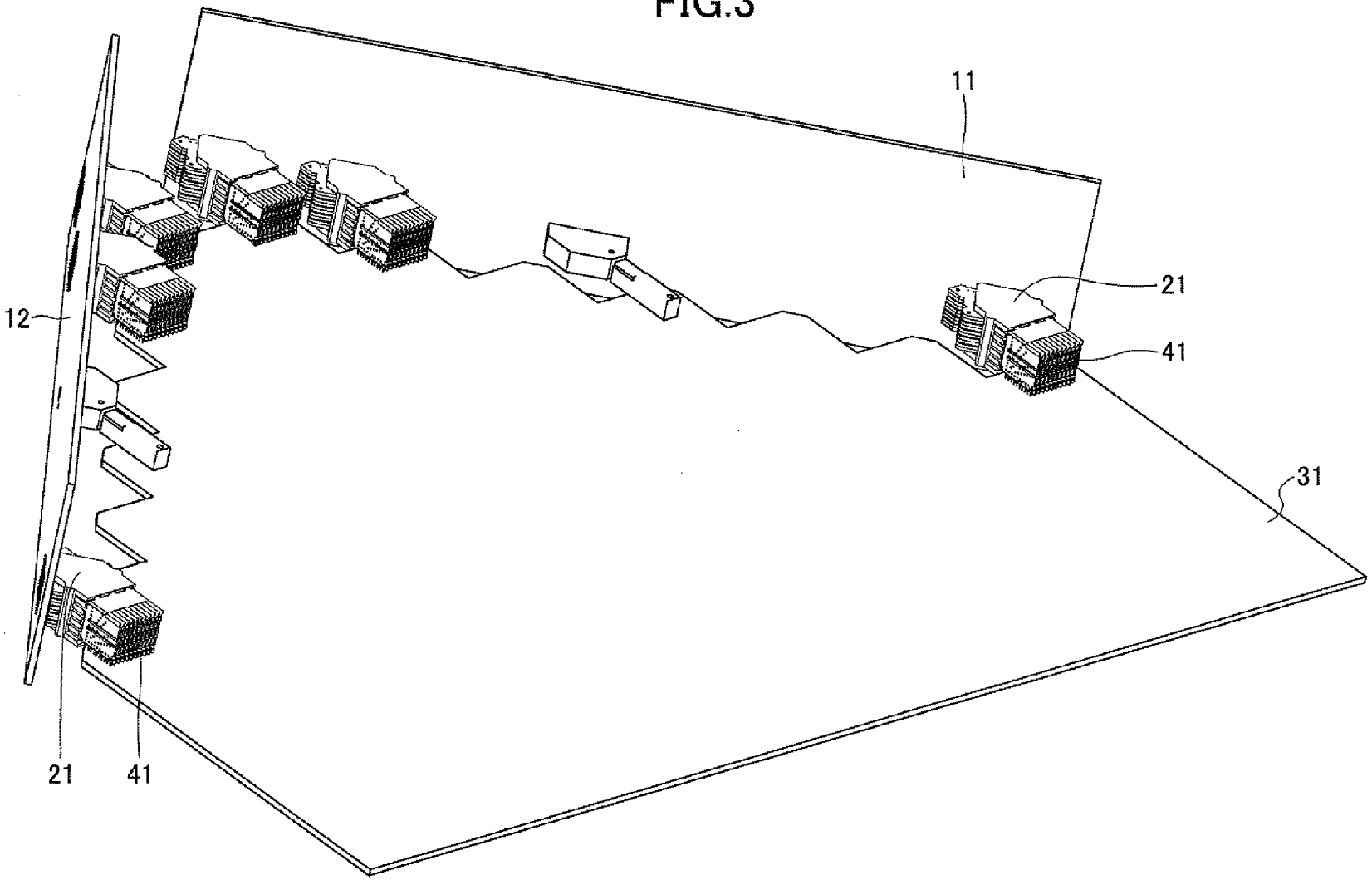
FIG. 3 is a perspective view of the board configured to be connected to the backplane of the embodiment of the present invention.

Details of connections between the boards 31, 32, 33, and 34 and the backplanes 11, 12, 13, and 14 are discussed with reference to FIG. 2 and FIG. 3. Here, FIG. 2 is a top view of the board 31 configured to be connected to the backplanes 11 and 12 of the embodiment of the present invention. FIG. 3 is a perspective view of the board 31 configured to be connected to the backplanes 11 and 12 of the embodiment of the present invention. As shown in FIG. 2 and FIG. 3, two sides of the board 31 to be connected to the backplanes 11 and 12 are formed in step shape manners. Plural receiving connectors 41 are provided at step shape parts of the board 31.

On the other hand, plural inserting connectors 21 corresponding to plural receiving connectors 41 are provided at the backplanes 11 and 12. A case where a single board 31 is provided at two backplanes 11 and 12 is illustrated in FIG. 2 and FIG. 3. However, by the same method, plural boards 31 can be provided so as to be stacked in a direction orthogonal to the sheet of FIG. 2. In this case, plural inserting connectors 21 are provided at the backplanes 11 and 12 in the direction orthogonal to the sheet of FIG. 2. By engaging the inserting connectors 21 with the receiving connectors 41 provided at the board 31, it is possible to provide plural boards 31.

(Receiving Connector)

Figure 4:
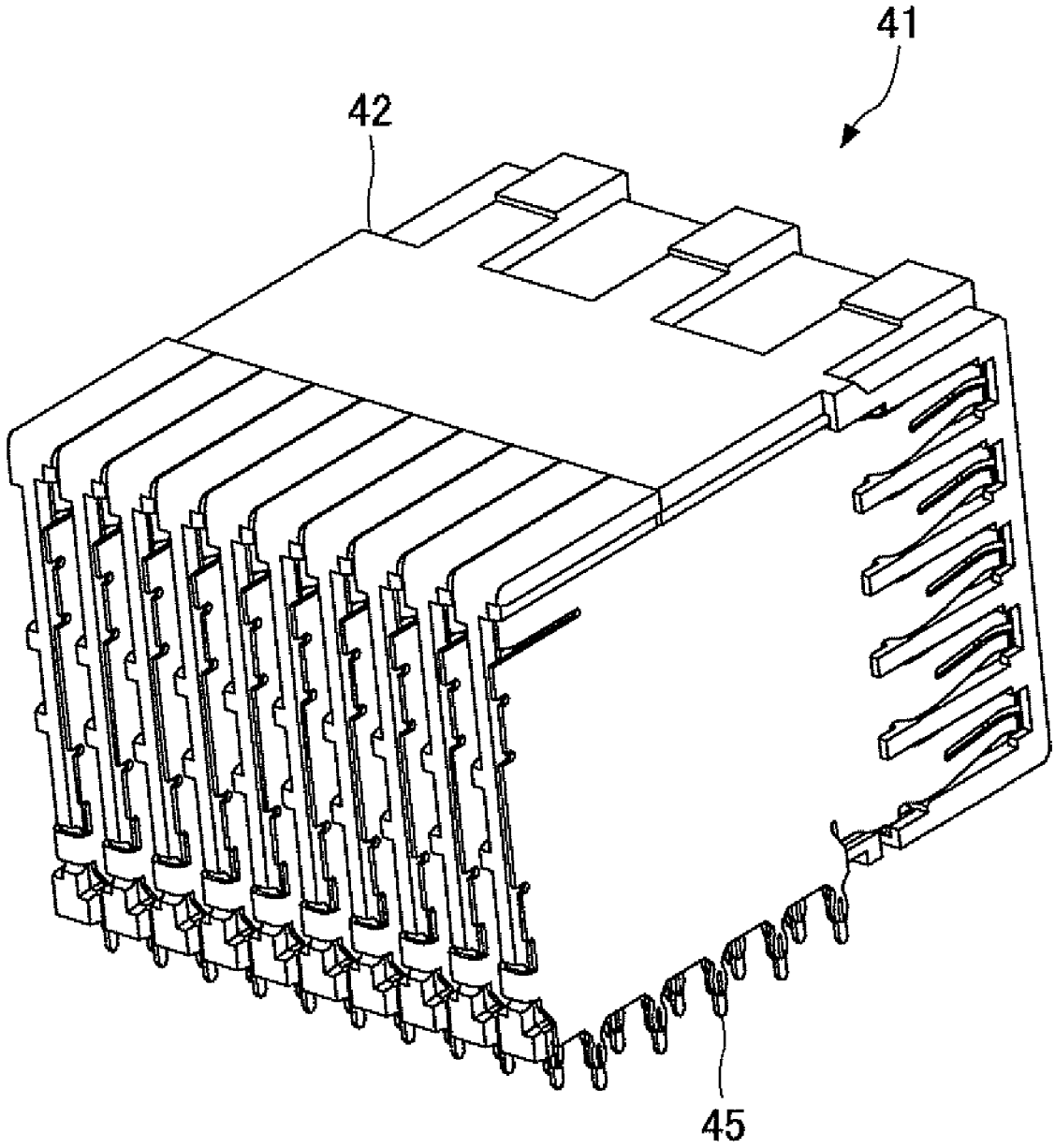
FIG. 4 is a first perspective view of a receiving connector forming a connector unit of the embodiment of the present invention.
Figure 5:
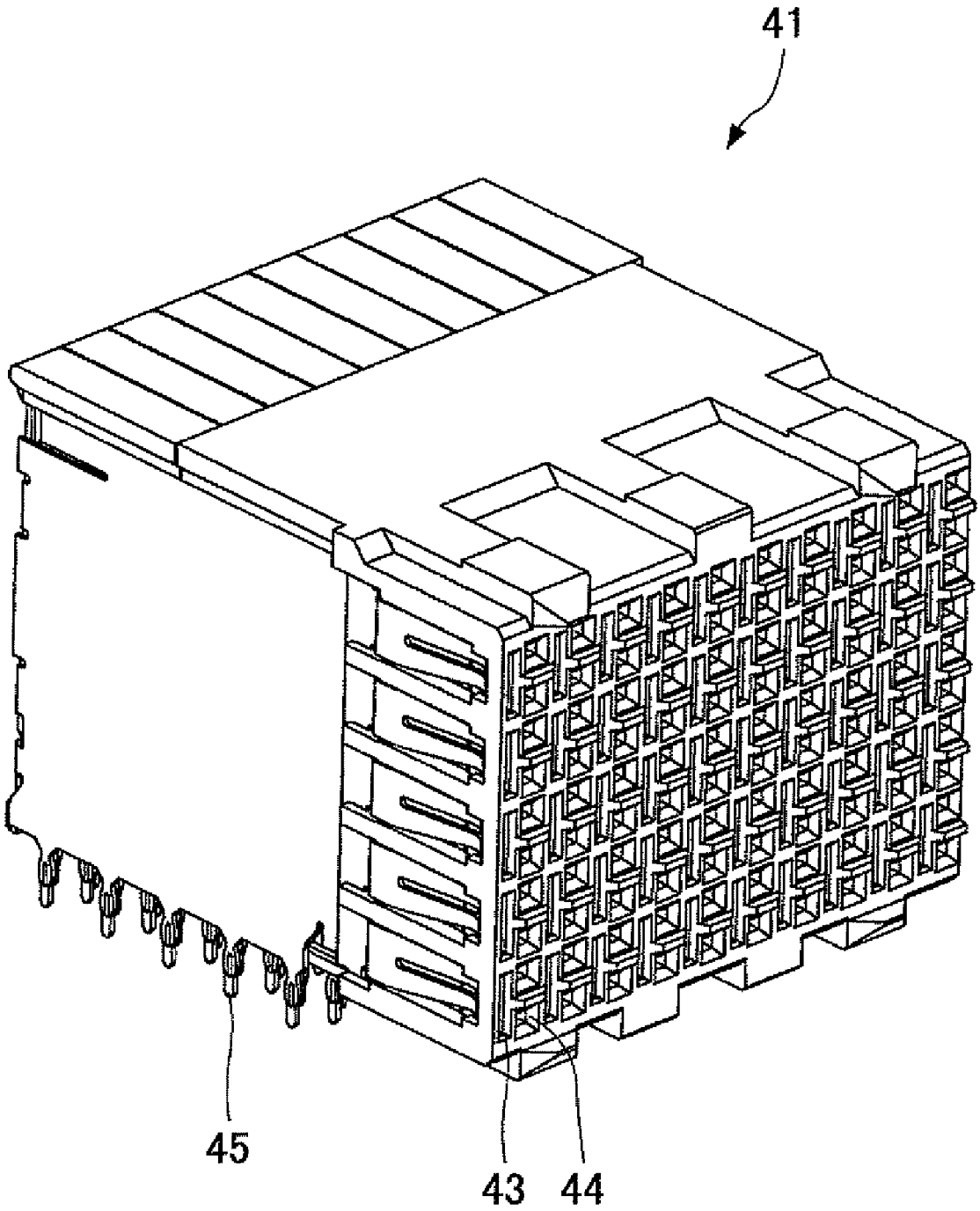
FIG. 5 is a first perspective view of the receiving connector forming the connector unit of the embodiment of the present invention.

Next, the receiving connector 41 is discussed with reference to FIG. 4 and FIG. 5. FIG. 4 is a perspective view seen in a rear surface direction of the receiving connector 41. FIG. 5 is a perspective view seen in a front surface direction of the receiving connector 41. In the receiving connector 41, plural opening parts 43 and 44 are mutually provided at a front surface of the housing 42 in a two-dimensional manner. A ground jack is provided inside the opening part 43. A jack contact is provided inside the opening part 44. The ground jack and the jack contact have substantially 90-degree bent configurations so that lower parts of the ground jack and the jack contact extending from a housing 42 form connecting terminals 45. The connecting terminals 45 and terminals provided at the boards 31, 32, 33, and 34 shown in FIG. 2 and others are electrically connected to each other.

(Inserting Connector)

Figure 6:
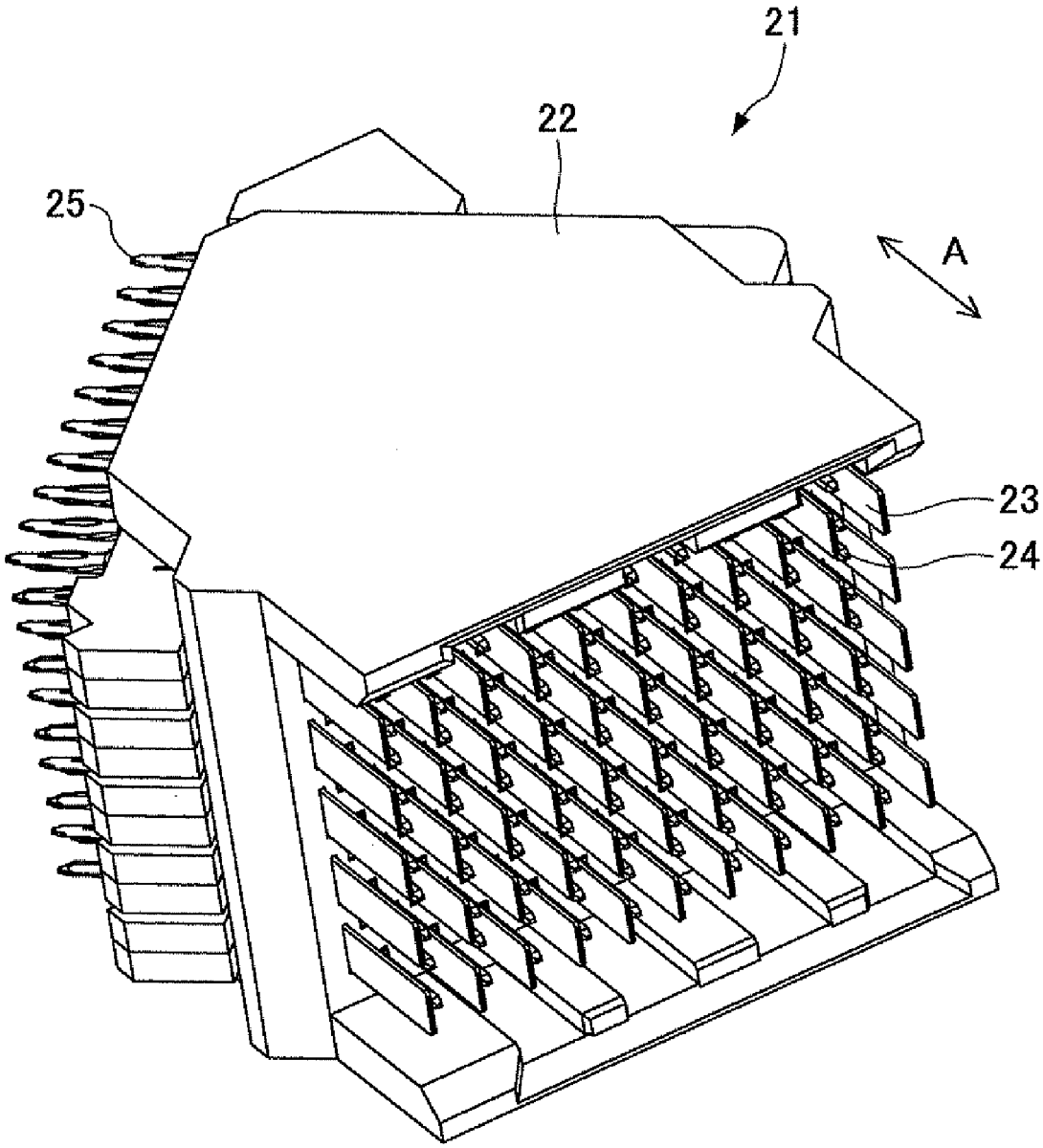
FIG. 6 is a first perspective view of an inserting connector of the embodiment of the present invention.
Figure 7:
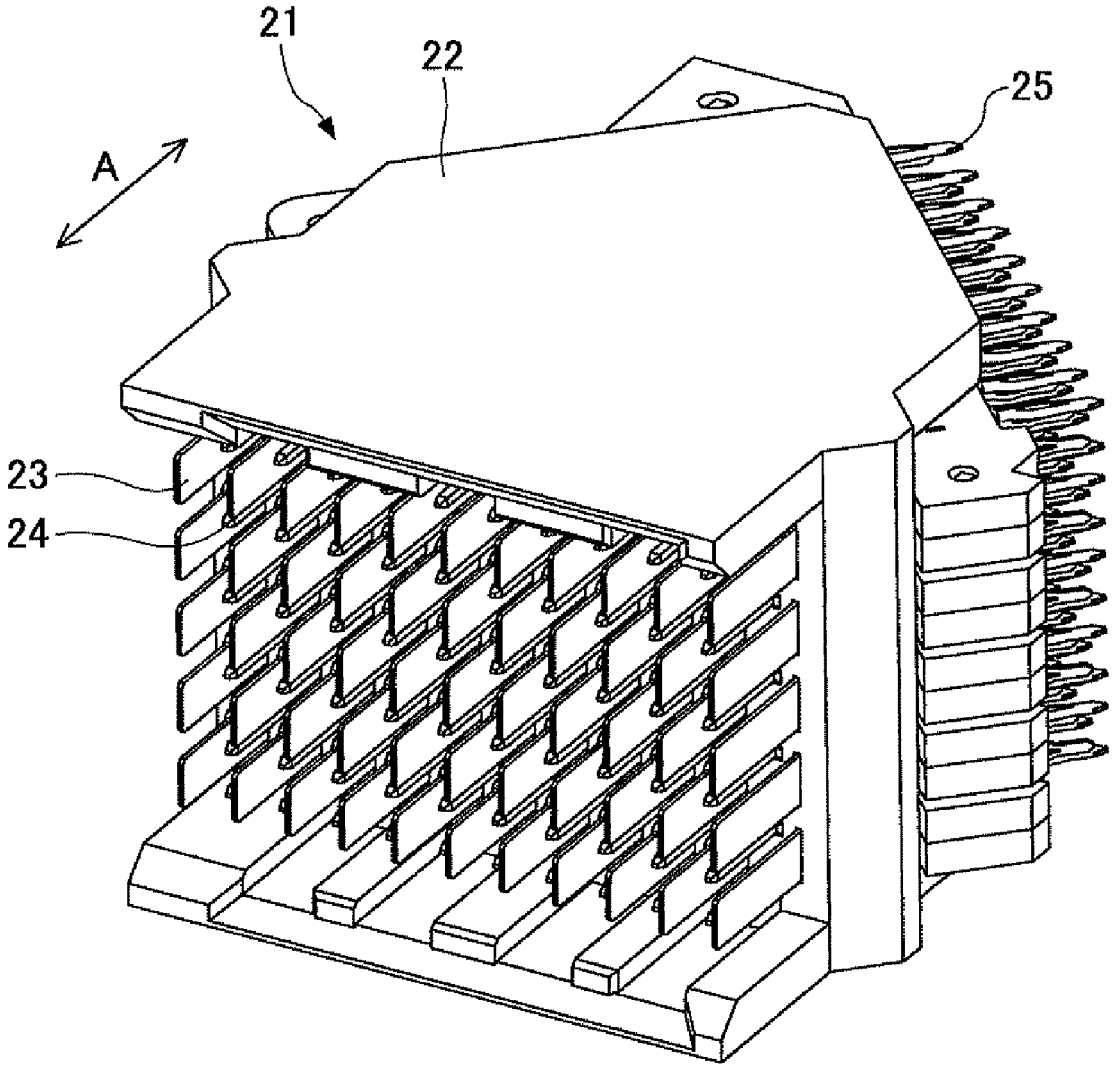
FIG. 7 is a second perspective view of the inserting connector of the embodiment of the present invention.

Next, the inserting connector 21 is discussed with reference to FIG. 6 and FIG. 7. Here, FIG. 6 is a perspective view seen in a front surface left direction of an inserting connector 21 of the embodiment of the present invention. FIG. 7 is a perspective view seen in a front surface right direction of the inserting connector 21 of the embodiment of the present invention. In the inserting connector 21, plural ground plugs 23 as ground plug terminals and plural plug contacts 24 as plug terminals are provided at a front surface of a housing 22 in a two-dimensional manner. In addition, connecting terminals 25 configured to be electrically connected with the ground plugs 23 and the plug contacts 24 are provided at the rear surface of the inserting connector 21. The connecting terminals 25 and terminals of the backplane 11 are electrically connected to each other. The ground plug 23 and the plug contact 24 have configurations where the ground plug 23 and the plug contact 24 extend in the removable direction indicated by the arrow A. The ground plug 23 and the plug contact 24 are electrically connected to the receiving connector 41.

Figure 8:
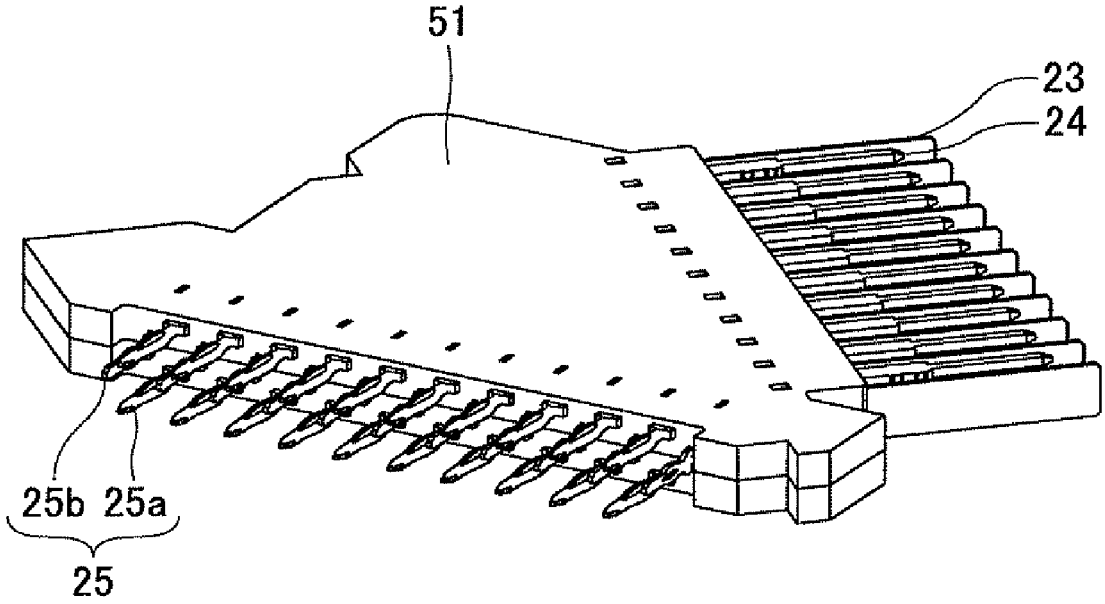
FIG. 8 is a perspective view of an electrode module forming the inserting connector of the embodiment of the present invention.

Next, the ground plug 23 and the plug contact 24 are discussed with reference to FIG. 8 and FIG. 9. The inserting connector 21 is formed, as illustrated in FIG. 8, by receiving electrode modules 51 stacked in a multi-step manner (five steps in the example illustrated in FIG. 6 and FIG. 7) into the housing 22. The electrode module 51 is formed by unifying the ground plugs 23 arranged in a single line and the plug contacts 24 arranged in a single line.

Figure 9:
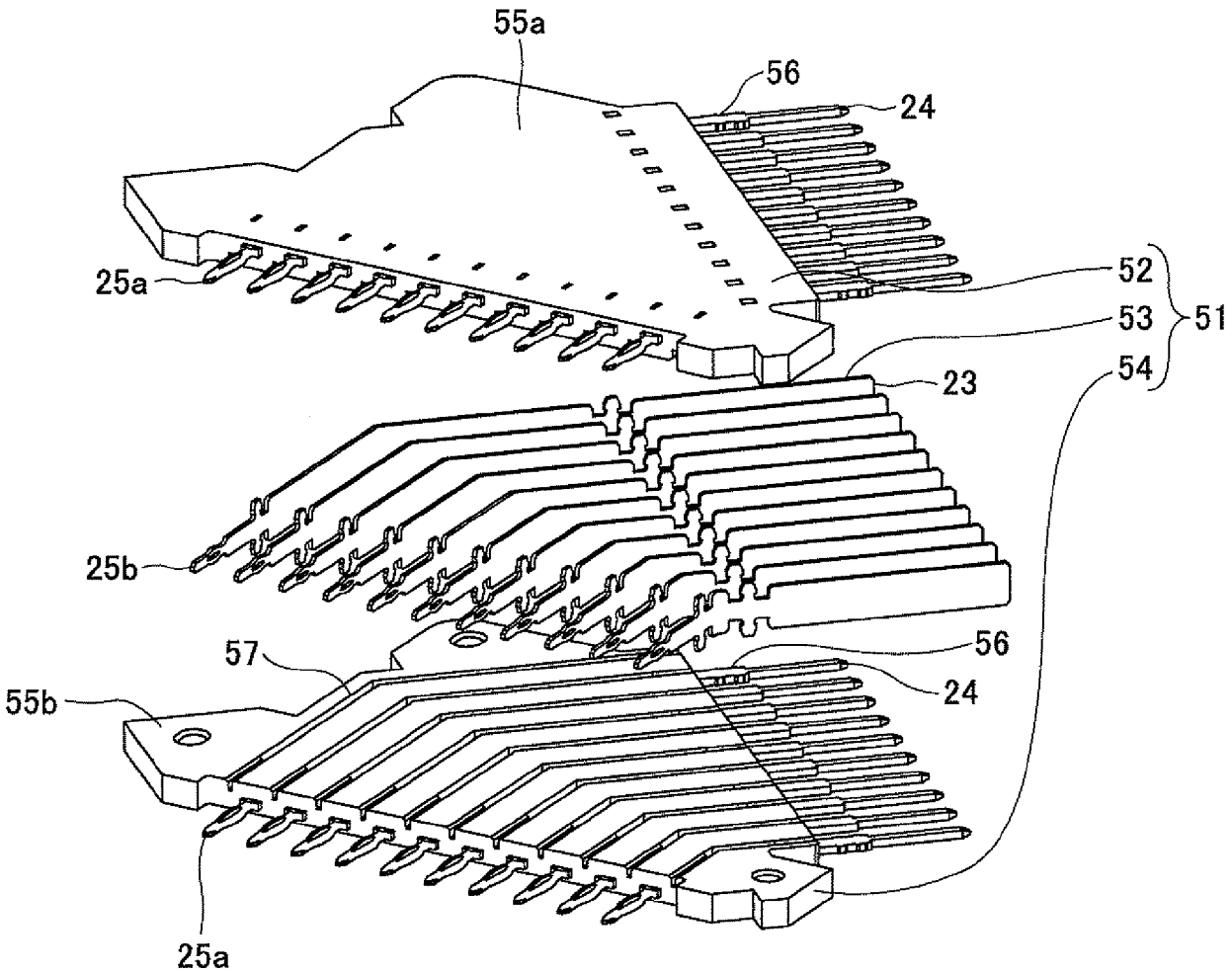
FIG. 9 is a structural view of the electrode module forming the inserting connector of the embodiment of the present invention.

The electrode module 51, as illustrated in FIG. 9, is formed by an electrode module upper part 52, a ground electrode 53, and an electrode module lower part 54. The connecting terminal 25 of the electrode module 51 includes a plug connecting terminal 25*a* and a ground connecting terminal 25*b*.

The electrode module upper part 52 is formed by arranging plural stick-shaped plug electrodes 56 and unifying the plug electrodes 56 with an insulative resin material part 55*a*. The plug contact 24 is provided at one side of the plug electrode 56. The plug connecting terminal 25*a* is provided at another side of the plug electrode 56. The plug electrode 56 is made of a conductive material such as metal. The plug electrode 56 is bent at approximately 45 degrees inside the resin material part 55*a*. The plug electrodes 56 are arranged in a single-line manner so that the head ends of the plug contacts 24 and the head ends of the plug connecting terminals 25*a* are regularly situated. In other words, the plug contacts 24 are arranged so that the head ends of the plug contacts 24 are aligned at a surface perpendicular to a direction in which the plug contacts 24 extend. The plug connecting terminals 25*a* are arranged so that the head ends of the plug connecting terminals 25*a* are aligned at a surface perpendicular to a direction in which the plug connecting terminals 25*a* extend. Because of this, the plug electrodes 56 are arranged in order so that lengths of the successive plug electrodes 56 are longer as the plug electrodes 56 are situated from one side end to another side end. In an example illustrated in FIG. 9, ten plug electrodes 56 are arranged in order of their lengths and unified by the resin material part 55*a*. Insulation among the plug electrodes 56 is provided by the resin material 55*a*. As discussed below, a groove is provided at a rear surface of the electrode module upper part 52 so that the ground electrode 53 is fixed.

The ground electrode 53 is made of a plate-shaped conductive material such as metal. In the ground electrode 53, a ground plug 23 is provided at one end and ground connecting terminal 25*b* is provided at another end. The ground electrode 53, similar to the plug electrode 56, is bent at approximately 45 degrees. The head ends of the ground plugs 23 and the head ends of the plug connecting terminals 25*b* are regularly situated. In other words, the ground plugs 23 are arranged so that the head ends of the ground plugs 23 are aligned at a surface perpendicular to a direction in which the ground plugs 23 extend. The ground connecting terminals 25*b* are arranged so that the head ends of the ground connecting terminals 25*b* are aligned at a surface perpendicular to a direction in which the ground connecting terminals 25*b* extend. Because of this, the ground electrodes 53 are arranged in order so that lengths of the successive ground electrodes 53 are longer as the ground electrodes 53 are situated from one side end to another side end. In an example illustrated in FIG. 9, eleven ground electrodes 53 are arranged in order of their lengths.

The electrode module lower part 54, similar to the electrode module upper part 52, is formed by arranging the plural stick-shaped plug electrodes 56 and unifying the plug electrodes 56 with an insulative resin material part 55*b*. The plug contact 24 is provided at one side of the plug electrode 56. The plug connecting terminal 25*a* is provided at another side of the plug electrode 56. The plug electrode 56 is made of a conductive material such as metal. The plug electrode 56 is bent at approximately 45 degrees inside the resin material part 55*b*. The plug electrodes 56 are arranged in a single-line manner so that the head ends of the plug contacts 24 and the head ends of the plug connecting terminals 25*a* are regularly situated. In other words, the plug contacts 24 are arranged so that the head ends of the plug contacts 24 are aligned at a surface perpendicular to a direction in which the plug contacts 24 extend. The plug connecting terminals 25*a* are arranged so that the head ends of the plug connecting terminals 25*a* are aligned at a surface perpendicular to a direction in which the plug connecting terminals 25*a* extend. Because of this, the plug electrodes 56 are arranged in order so that lengths of the successive plug electrodes 56 are longer as the plug electrodes are situated from one side end to another side end. In an example illustrated in FIG. 9, ten plug electrodes 56 are arranged in order of their lengths and unified by the resin material part 55*b*. Insulation among the plug electrodes 56 is provided by the resin material 55*b*. In addition, a groove part is provided at a top surface of the electrode module lower part 54 so that the ground electrodes 53 are fixed. Similarly, the ground electrodes 53 are sandwiched by the groove part provided at the top surface of the electrode module lower part 54 and the groove part provided at the rear surface of the electrode module upper part 52 so as to be fixed. Thus, the electrode module 51 is formed by sandwiching the ground electrodes 53 with the electrode module upper part 52 and the electrode module lower part 54 and fixing the ground electrodes 53.

Figure 10:
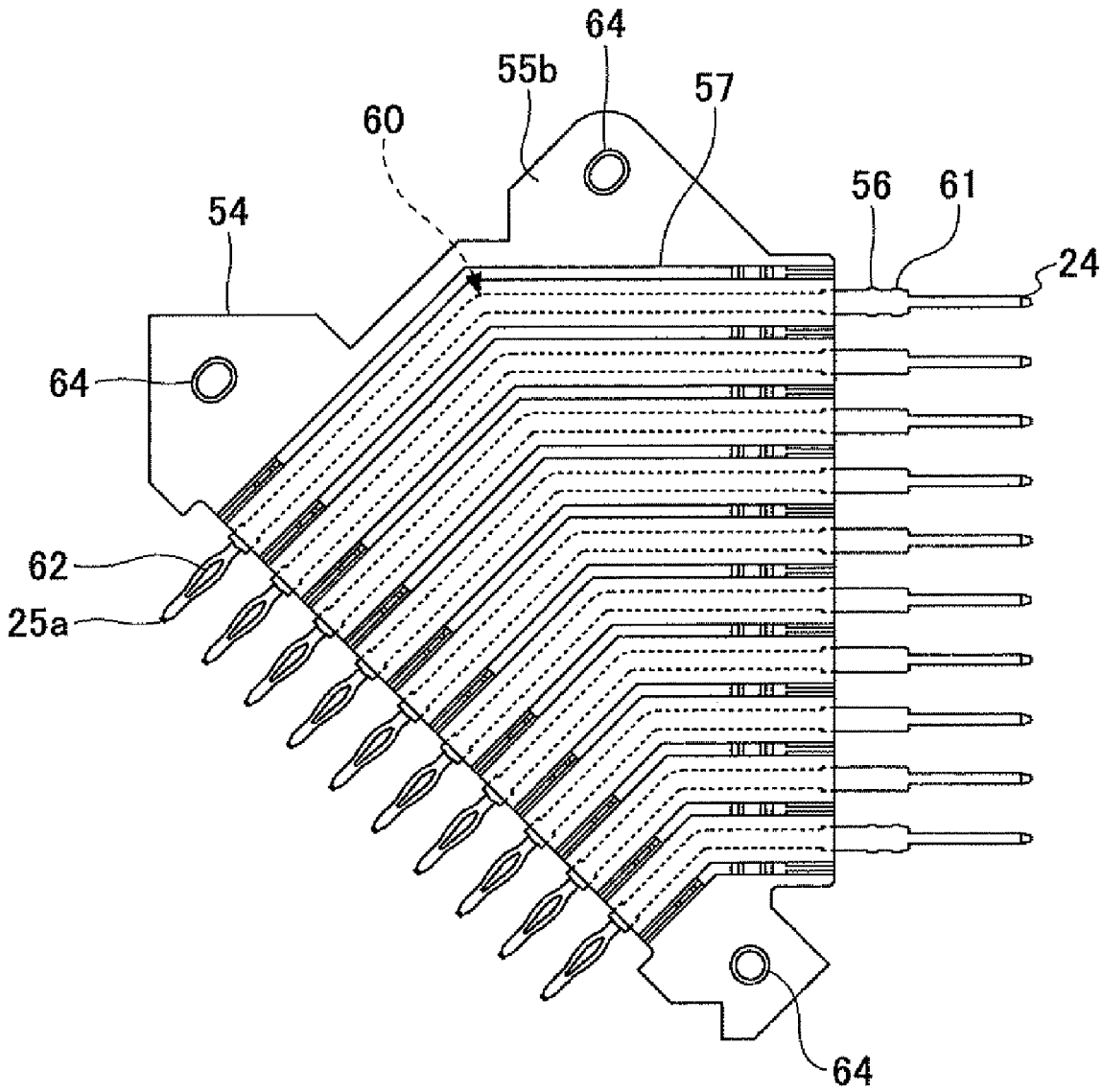
FIG. 10 is a top view of an electrode module lower part.
Figure 11:
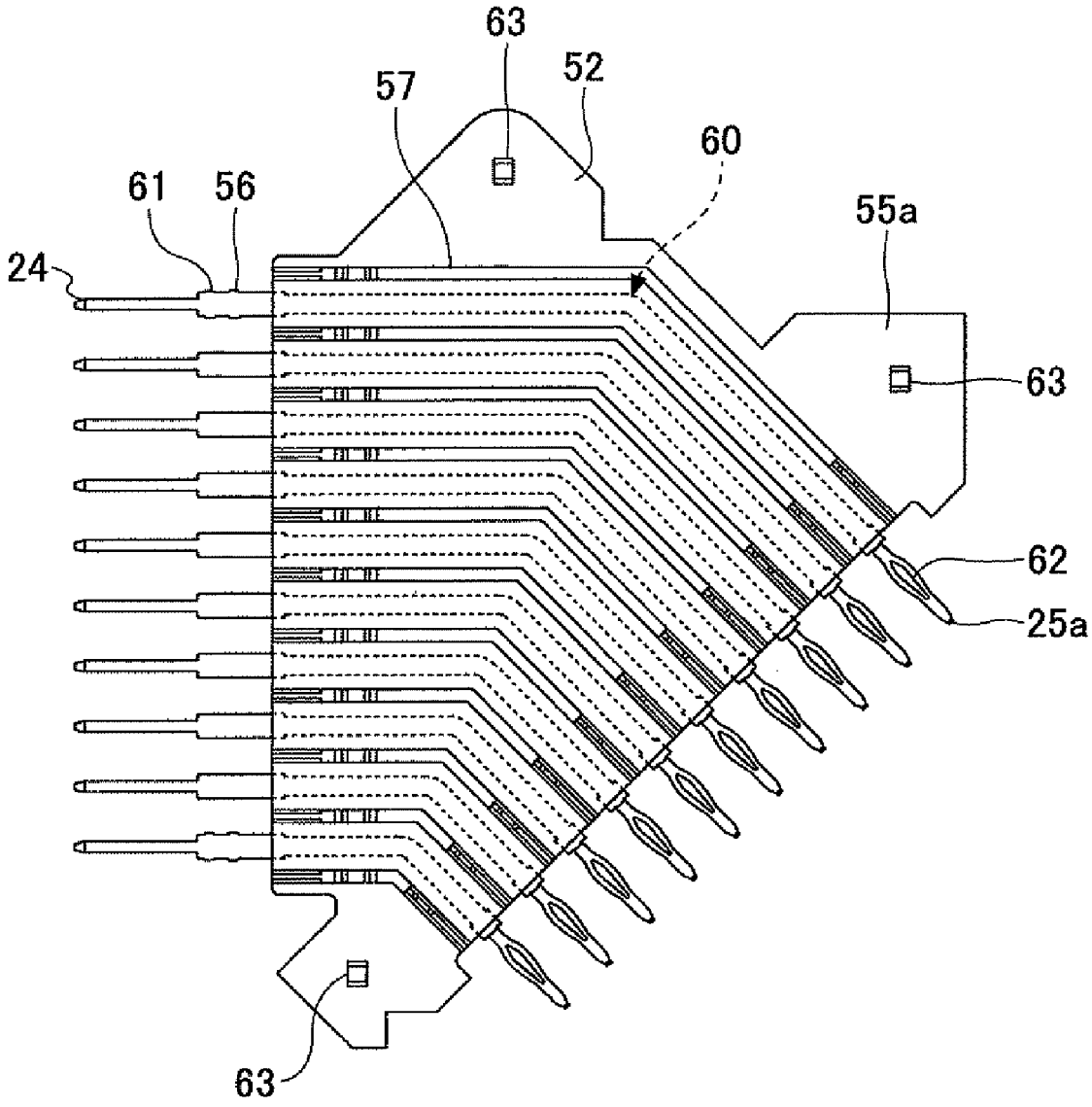
FIG. 11 is a bottom view of an electrode module upper part.

Next, details of the electrode module upper part 52 and the electrode module lower part 54 are discussed with reference to FIG. 10 and FIG. 11. Here, FIG. 10 is a top view of the electrode module lower part 54. FIG. 11 is a bottom view of the electrode module upper part 52. As discussed above, the groove parts 57 are provided at the electrode module upper part 52 and the electrode module lower part 54 so that the ground electrodes 53 are fixed. The plug electrode 56 is bent at a bending part 60 situated in the substantially center part of the plug electrode 56 at approximately 45 degrees. The plug electrodes 65 are arranged in order of the lengths of the plug electrodes 65. A bulge part 61 is provided at the bending part 60 side of the vicinity of the contact plug 24 of the plug electrode 56. When the electrode module 51 is attached to the housing 22, the plug electrode 56 is held by the bulge part 61. In addition, the plug connecting terminal 25*a* of the plug electrode 56 includes a connecting part 62 having a compliant pin structure and therefore the plug electrodes 56, the backplane 11 and other parts can be electrically connected to each other without using solder. In order to connect the electrode module upper part 52 and the electrode module lower part 54 to each other, lock parts 63 are provided at the electrode module upper part 52 and lock parts 64 are provided at the electrode module lower part 54. The lock parts 63 and 64 are formed at the same time when the resin material part 55*a* of the electrode module upper part 52 and the resin material part 55*b* of the electrode module lower part 54 are formed. By connecting the lock parts 63 and the lock parts 64 to each other, the electrode module upper part 52 and the electrode module lower part 54 are unified so that the electrode module 51 is formed where the ground electrode 53 is sandwiched.

Figure 12:
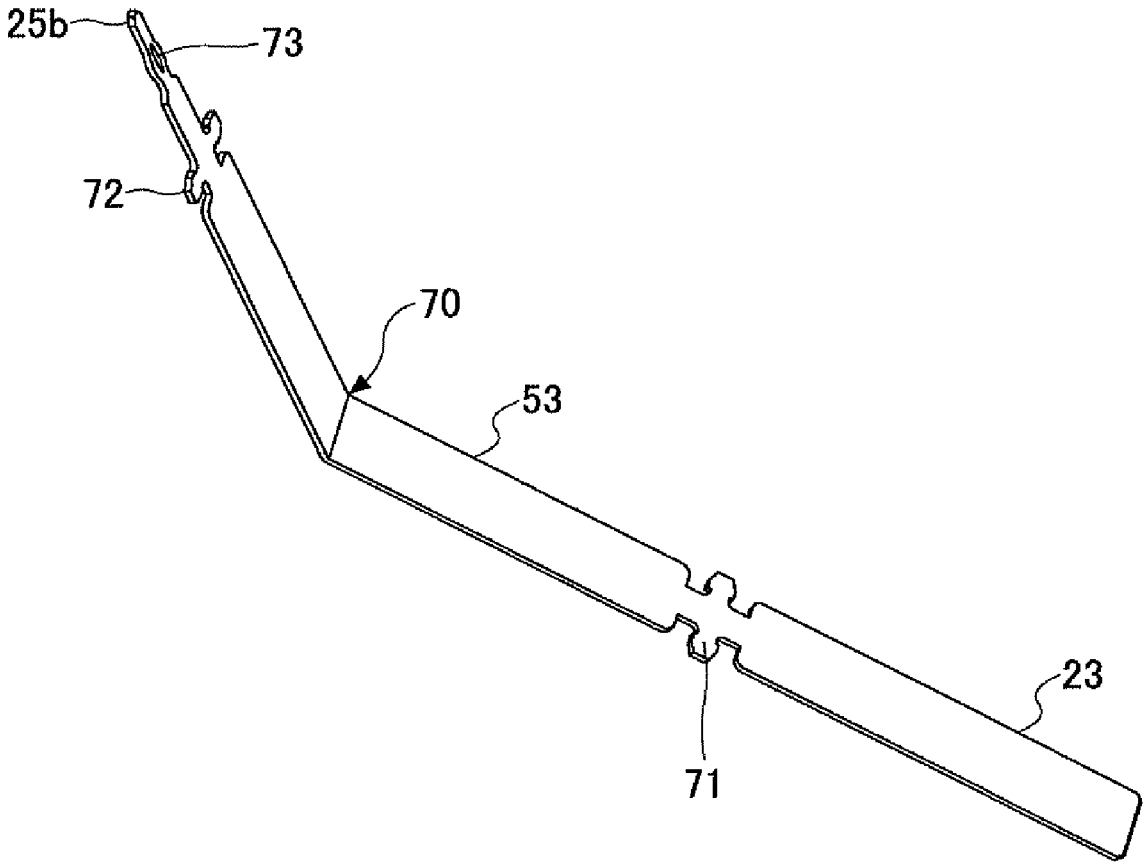
FIG. 12 is a perspective view of a ground electrode.

Next, details of the ground electrode 53 are discussed with reference to FIG. 12. FIG. 12 is a perspective view of the ground electrode 53. The ground electrode 53 is, as discussed above, bent at a bending part 70 situated in the substantially center part of the ground electrode 53 at approximately 45 degrees. A bulge part 71 is provided at the bending part 70 side of the vicinity of the ground plug 23 of the ground electrode 53. In addition, a bulge part 72 is provided at the bending part 70 side of the vicinity of the ground connecting terminal 25*b*. The bulge parts 71 and 72 hold the ground electrode 53 at the groove part 57 when the ground electrode 53 is fixed by the electrode module upper part 52 and the electrode module lower part 54. In addition, the ground connecting terminal 25*b* of the ground electrode 53 includes a connecting part 73 having a compliant pin structure and therefore the ground electrode 53, the backplane 11 and other parts can be electrically connected to each other without using solder. Since the ground electrode 53 is fixed at the groove parts 57 of the electrode module upper part 52 and the electrode module lower part 54, insulation of the plug electrodes 56 and the ground electrodes 53 is made via the resin material parts 55*a* and 55*b*. Thus, the electrode module 51 is formed.

Figure 13:
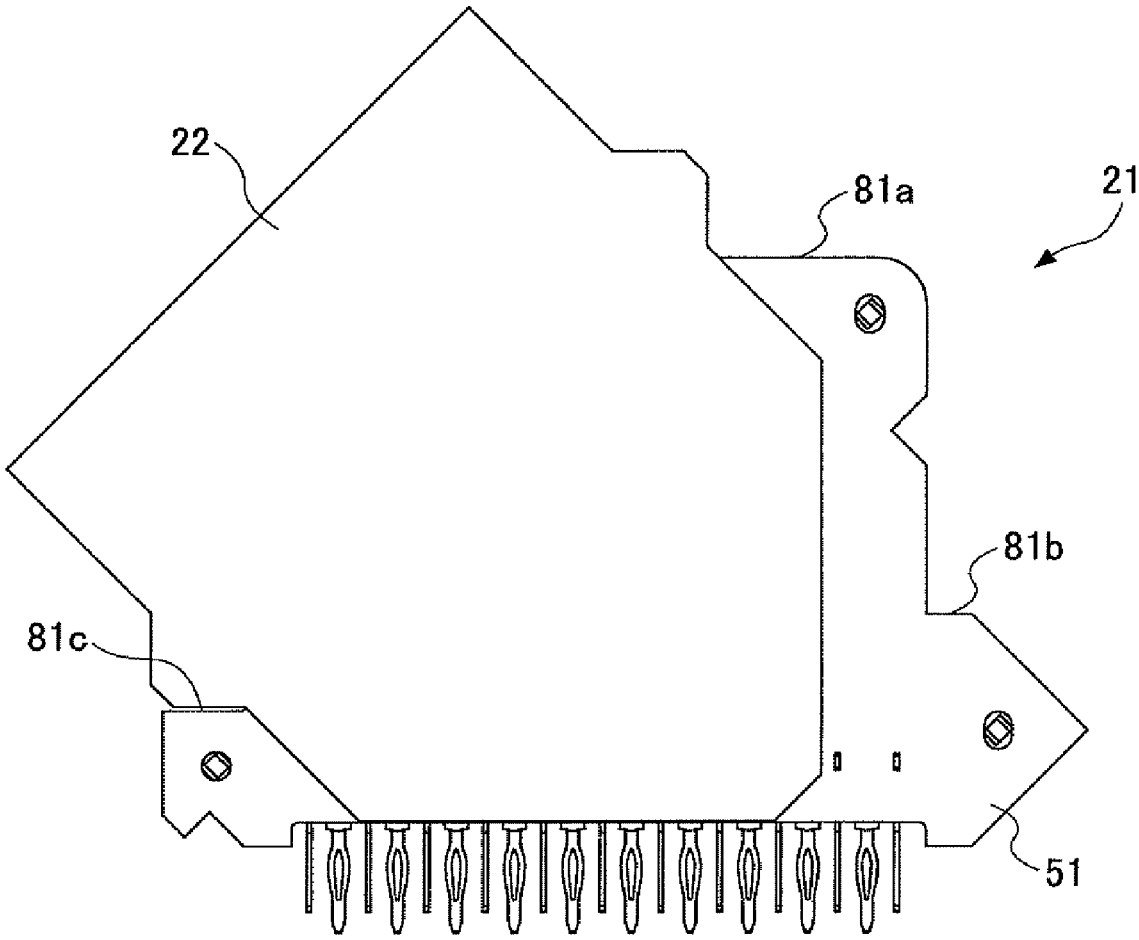
FIG. 13 is a top view of the inserting connector of the embodiment of the present invention.

The inserting connector 21 is made by attaching plural electrode modules 51 into the housing 22. Here, FIG. 13 is a top view of the inserting connector 21 of the embodiment of the present invention. As shown in FIG. 13, the electrode module 51 to be attached to the housing 22 includes parallel parts 81*a*, 81*b*, and 81*c* including a surface parallel with the surface of the backplane 11 where the inserting connector 21 is attached. The parallel parts 81*a*, 81*b*, and 81*c* may be provided on at least one portion of a single electrode module 51 and are used for positioning or the like.

Figure 14:
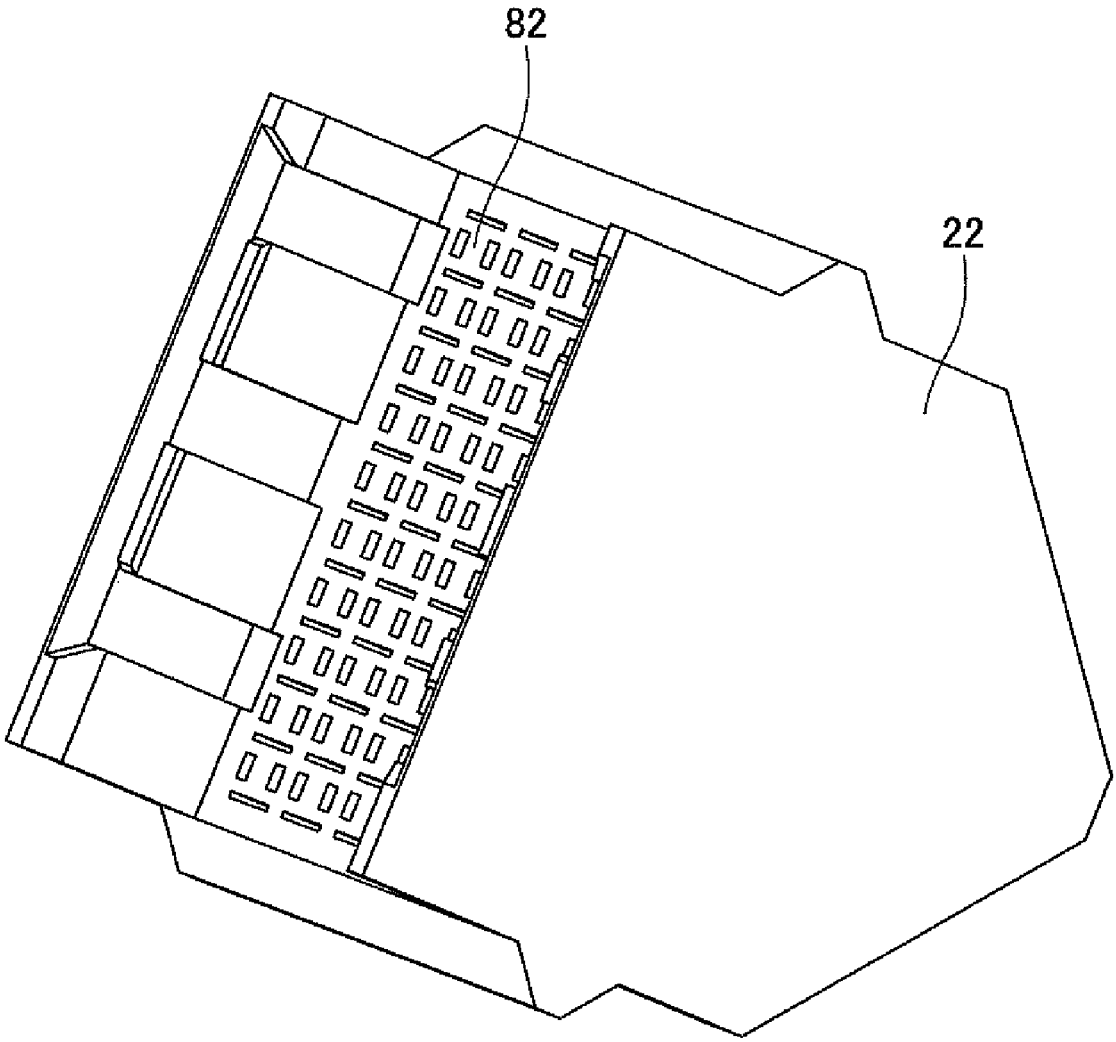
FIG. 14 is a first perspective view of a housing forming the inserting connector of the embodiment.
Figure 15:
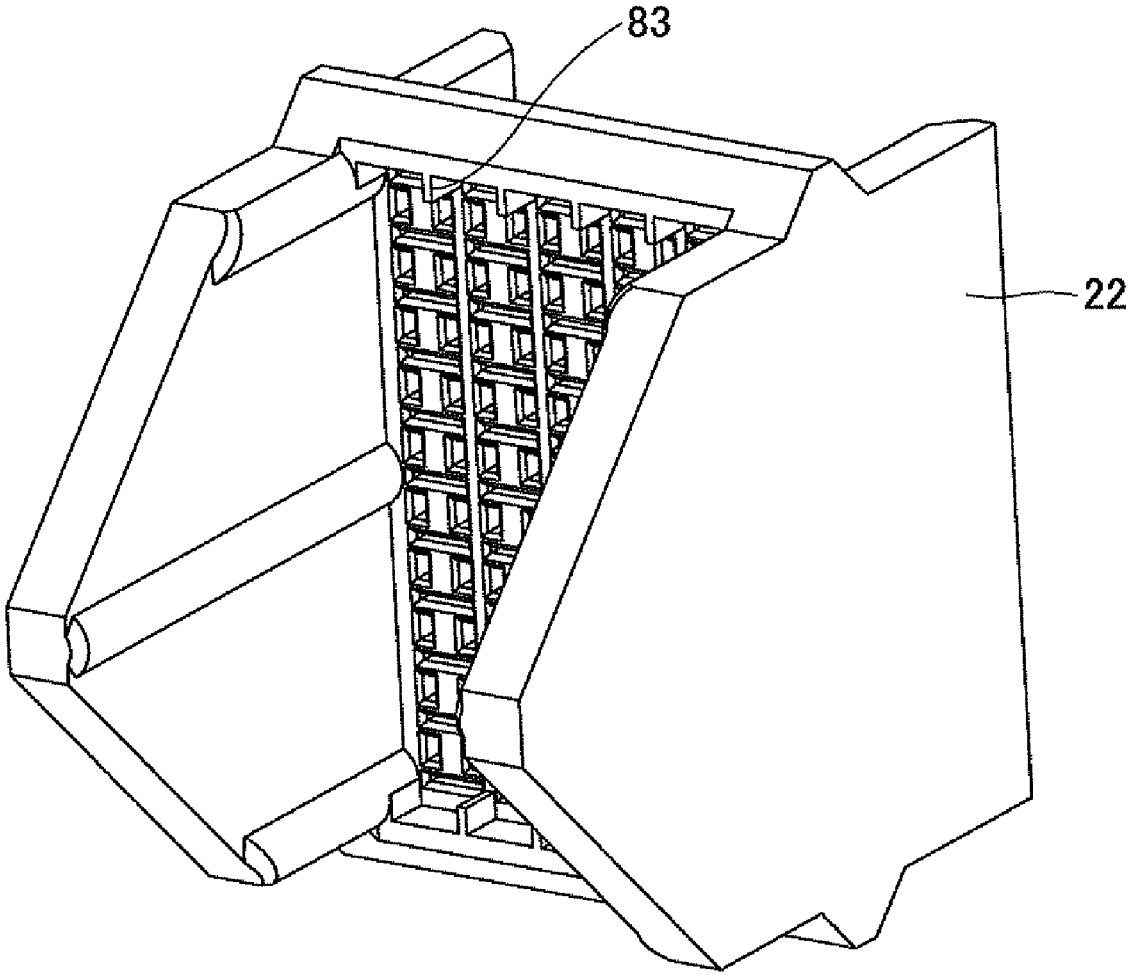
FIG. 15 is a second perspective view of the housing forming the inserting connector of the embodiment.

The housing 22 of the inserting connector 21 is discussed with reference to FIG. 14 and FIG. 15. FIG. 14 is a perspective view seen in a front surface direction of the housing 22 and FIG. 15 is a perspective view seen in a rear surface direction of the housing 22. An engaging surface 82 is formed at the front surface of the housing 22. The engaging surface 82 is configured to engage with the receiving connector 41. The engaging surface 82 forms an angle of approximately 45 degrees with respect to the backplane 11 or the like. Groove parts 83 are provided at the rear surface side of the engaging surface 82 of the housing 22 so that plural electrode modules 51 are regularly provided. By regularly providing the plural electrode modules 51, the head ends of the ground plugs 23 and the plug contacts 24 are regularly provided at a vertical surface of a direction in which the head ends of the ground plugs 23 and the plug contacts 24 extend. With this structure, the head ends of the ground plugs 23 and the plug contacts 24 can be regularly provided in a vertical direction. All of the head ends of the ground plugs 23 and the plug contacts 24 can be regularly provided, in a two-dimensional manner, at the vertical surface of a direction in which the head ends of the ground plugs 23 and the plug contacts 24 extend.

In the above-discussed embodiment, a structure where four backplanes 11, 12, 13, and 14 are provided at right angles (90 degrees) with each other is discussed. However, the backplanes may be provided at any angles except that the backplanes may not be provided in parallel. In other words, as long as an angle $\beta$ formed by two backplanes is greater than 0 degrees and less than 180 degrees (0 degrees $<\beta<180$ degrees), any arrangement of the backplanes is available. In this case, bending angles of the ground electrodes 53 and the plug electrodes 56 of the inserting connector 21 are equal to $\beta/2$. Accordingly, the angle $\alpha$ is greater than 0 degrees and less than 90 degrees (0 degrees$<\alpha<$90 degrees). In the above-discussed example, a is equal to approximately 45 degrees.

The bending angles $\alpha$ of the ground electrodes 53 and the plug electrodes 56 of the inserting connector 21 provided at two backplanes may be different from each other in the two backplanes. When a bending angle of the ground electrodes 53 and the plug electrodes 56 of the inserting connector 21 provided at one backplane is defined as $\alpha 1$ and a bending angle of the ground electrodes 53 and the plug electrodes 56 of the inserting connector 21 provided at another backplane is defined as $\alpha 2$, the following equation may be satisfied. That is, $\alpha 1+\alpha 2=\beta$.

Furthermore, in the embodiment of the present invention, three backplanes may be provided at 120 degrees to each other. In this case, it is possible to achieve the same effect as that of the embodiment of the present invention by providing the inserting connectors at both surfaces of the backplanes so that $\alpha$ is approximately 60 degrees.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An inserting connector, comprising:

a plurality of plug electrodes where plug connecting terminals are provided at first ends of the plug electrodes and plug terminals are provided at second ends of the plug electrodes, the plug connecting terminals being configured to be connected to a board, the plug terminals being configured to be connected to jack terminals;

wherein the plug connecting terminals extend in a direction perpendicular to a surface of the board;

the plug terminals extend in a movable direction where the plug terminals are attached to or detached from the jack terminals;

the plug electrodes are bent at an angle $\alpha$ in longitudinal directions of the plug electrodes, the angle $\alpha$ being greater than 0 degrees and less than 90 degrees.

2. The inserting connector as claimed in claim 1, further comprising:

a plurality of ground electrodes where ground connecting terminals are provided at first ends of the ground electrodes and ground plug terminals are provided at second ends of the ground electrodes, the ground connecting terminals being configured to be connected to the board, the ground plug terminals being configured to be connected to ground jack terminals;

wherein the ground connecting terminals extend in a direction perpendicular to a surface of the board;

the ground plug terminals extend in a movable direction where the ground plug terminals are attached to or detached from the ground jack terminals; and the ground electrodes are bent at an angle $\alpha$ in longitudinal directions of the ground electrodes, the angle $\alpha$ being greater than 0 degrees and less than 90 degrees.

3. The inserting connector as claimed in claim 2, wherein the inserting connector includes a housing and a plurality of electrode modules;

each of the electrode modules includes an electrode module upper part where plural of the plug electrodes are arranged in a single-line manner and fixed by a resin material part, and an electrode module lower part where plural of the plug electrodes are arranged in a single-line manner and fixed by a resin material part, each of the electrode modules is formed by sandwiching the plural ground electrodes with the electrode module upper part and the electrode module lower part so that the electrode module is fixed; and the inserting connector is formed by stacking the electrode modules and fixing the electrode modules to the housing made of an insulator.

4. The inserting connector as claimed in claim 3, wherein a groove part is formed at each of the resin material part of the electrode module upper part and the resin material part of the electrode module lower part; and the ground electrodes are fixed at each of the groove parts.

5. The inserting connector as claimed in claim 4,
wherein the ground electrode includes a bulge part so as to be fixed at the groove part.

6. The inserting connector as claimed in claim 3,
wherein the plug electrode includes a bulge part so that the electrode module upper part or the electrode module lower part is fixed to the housing.

7. The inserting connector as claimed in claim 2,
wherein the plug terminals and the ground plug terminals are mutually arranged.

8. The inserting connector as claimed in claim 2,
wherein head ends of the plug terminals and head ends of the ground plug terminals are regularly provided at a vertical surface in a direction in which the plug terminals and the ground plug terminals extend.

9. The inserting connector as claimed in claim 1,
wherein the angle $\alpha$ is approximately 45 degrees or approximately 60 degrees.

10. The inserting connector as claimed in claim 2,
wherein the plug connecting terminal or the ground connecting terminal has a compliant pin structure so that electrical connection with the board is made without using a solder.

11. A connector unit, comprising:
the inserting connector as claimed in claim 1; and
a receiving connector provided at another board to be connected to the board, the receiving connector including the jack terminals where the plug terminals are inserted in the movable direction where the plug terminals are attached to or detached from the jack terminals.

12. A backplane provided as the board claimed in claim 1, the backplane being where the inserting connector as claimed in claim 1 is attached.

13. The backplane as claimed in claim 12,
wherein the backplane has inserting connectors attached to both surfaces.

14. The backplane as claimed in claim 12,
wherein, in a case where plural of the backplanes are provided at intervals of 90 degrees, the inserting connectors having the angle $\alpha$ of 45 degrees are attached to the backplanes.

15. The backplane as claimed in claim 12,
wherein, in a case where plural of the backplanes are provided at intervals of 120 degrees, the inserting connectors having the angle $\alpha$ of 60 degrees are attached to the backplanes.

16. The backplane as claimed in claim 12,
wherein another board to be connected to the backplane includes a receiving connector where the jack terminals are inserted in the movable direction; and
the other board is electrically connected to two of the backplanes by connection of plural of the receiving connectors and plural of the inserting connectors attached to the backplane.

* * * * *